United States Patent [19]

Shalek

[11] Patent Number: 4,513,612

[45] Date of Patent: Apr. 30, 1985

[54] MULTIPLE FLOW RATE FORMATION TESTING DEVICE AND METHOD

[75] Inventor: Walter F. Shalek, Bellaire, Tex.

[73] Assignee: Halliburton Company, Duncan, Okla.

[21] Appl. No.: 508,304

[22] Filed: Jun. 27, 1983

[51] Int. Cl.[3] ..... E21B 49/00

[52] U.S. Cl. ..... 73/155

[58] Field of Search ..... 73/155, 151; 166/100

[56] References Cited

U.S. PATENT DOCUMENTS

| | | | |
|---|---|---|---|
| 3,780,575 | 12/1973 | Urbanosky | 73/152 |
| 4,210,018 | 7/1980 | Brieger | 73/155 |
| 4,434,653 | 3/1984 | Montgomery | 73/155 X |

*Primary Examiner*—Jerry W. Myracle

*Attorney, Agent, or Firm*—William J. Beard

[57] ABSTRACT

A method and apparatus for measuring the permeability, as well as the deliverability, of earth formations traversing a well bore, includes drawing one or more formation flow tests, usually of small volume, from a given formation interval after the region of the formation immediately surrounding the test area is purged of well bore invasion fluid. The purging, done by first drawing a large fluid sample from the formation interval to remove well bore invasion fluid from the immediate area and displace it with connate formation fluid, provides thereby for determining the formation flow properties which obtain with the actual connate formation fluids, as well as for estimating formation damage due to prior invasion of well bore fluid.

12 Claims, 9 Drawing Figures

FIG.1
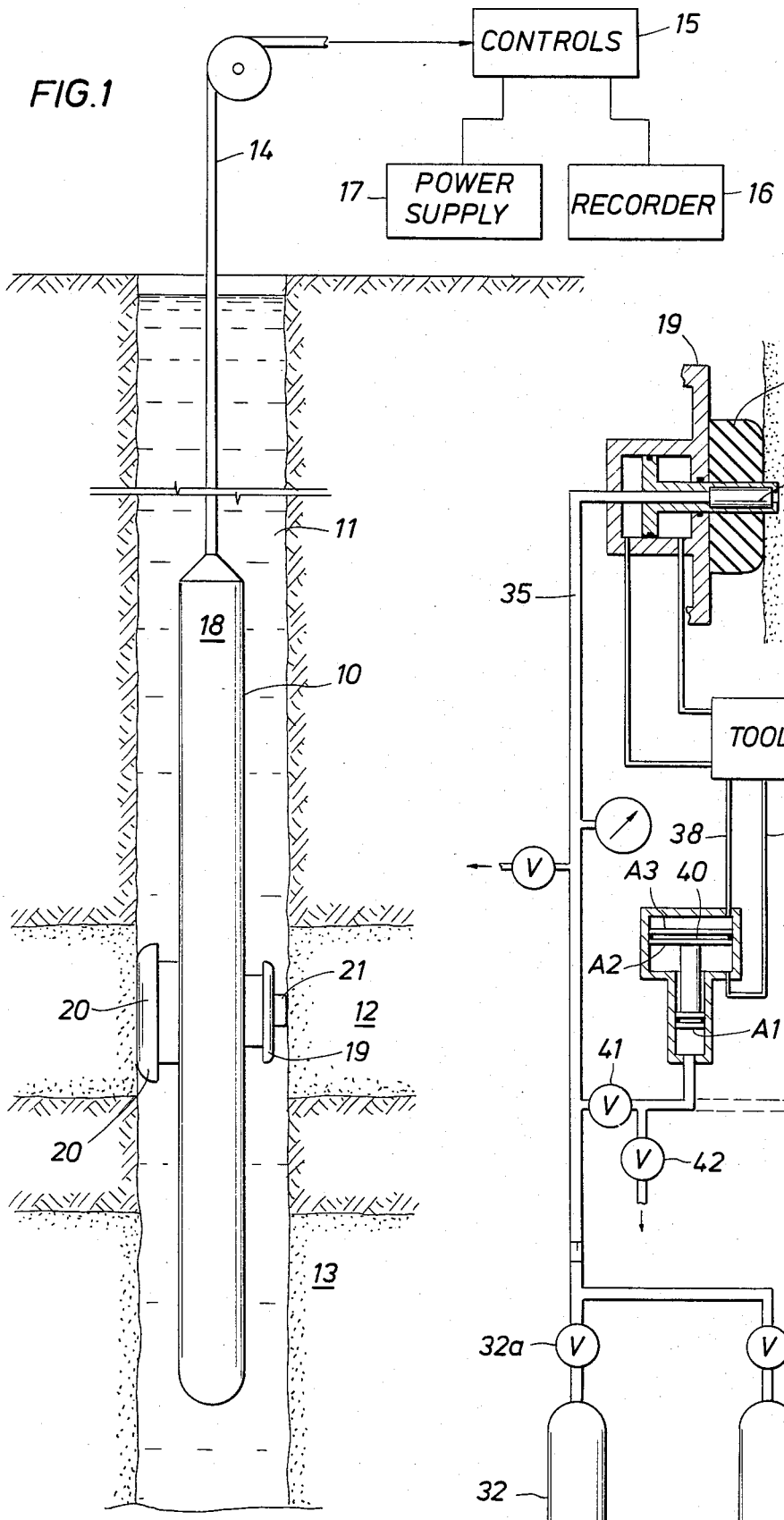
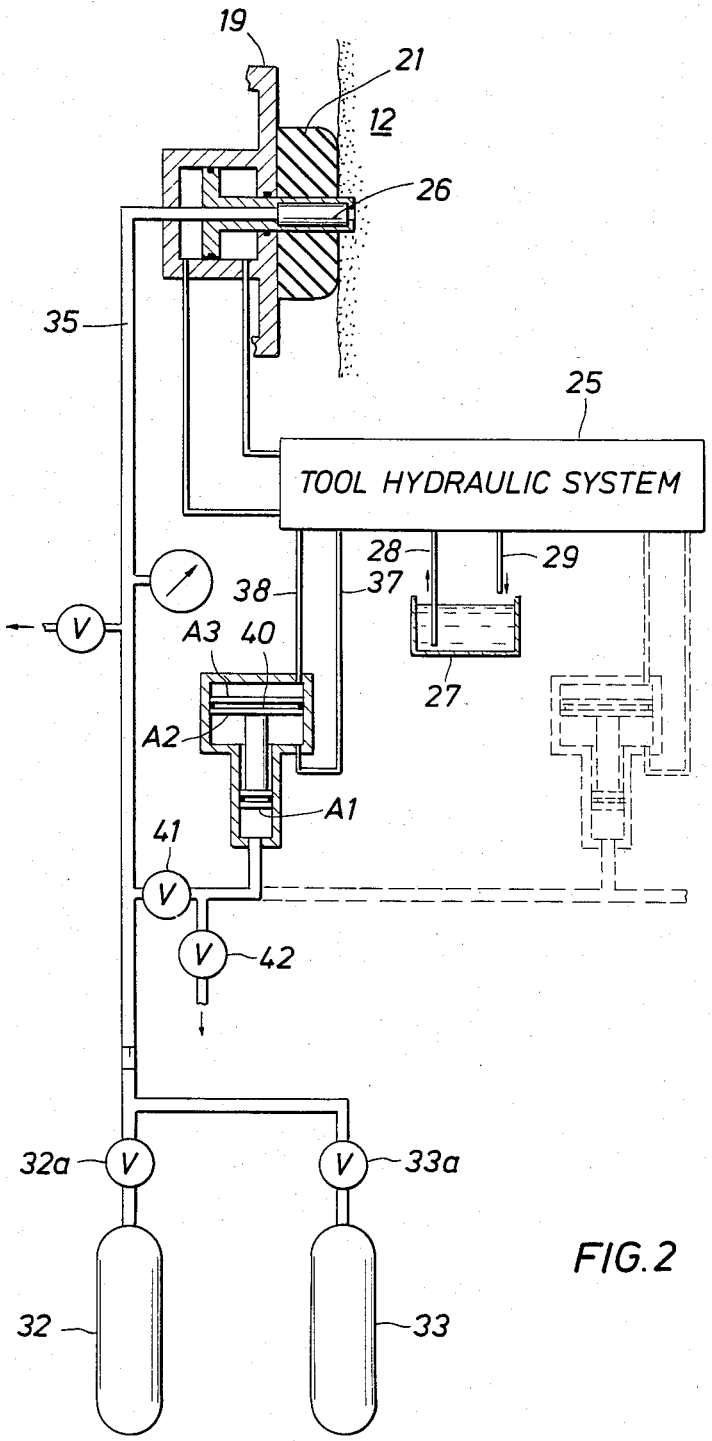
FIG.2

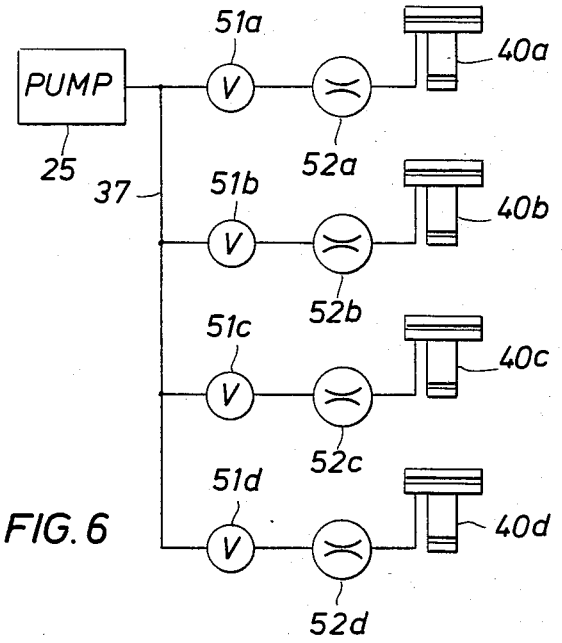
FIG. 6
FIG. 7
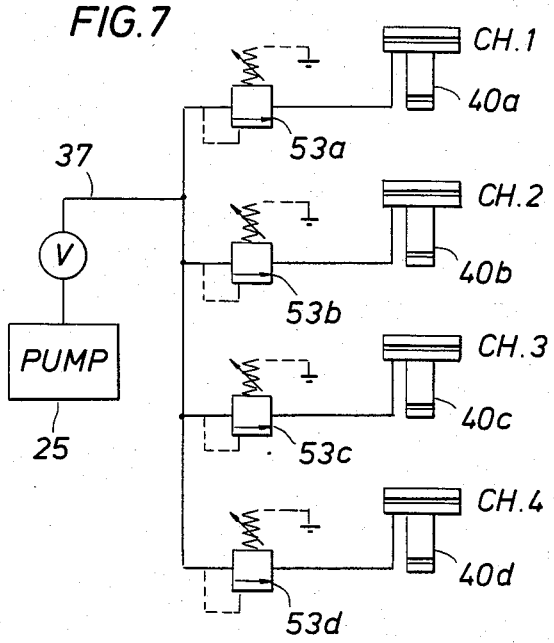
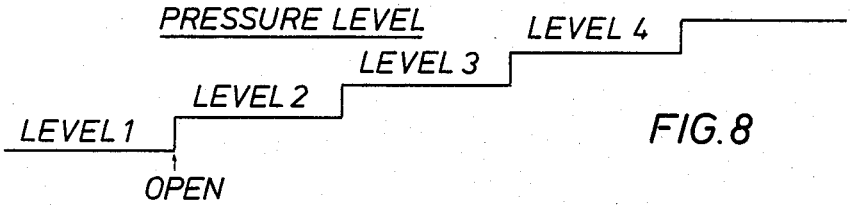
FIG. 8
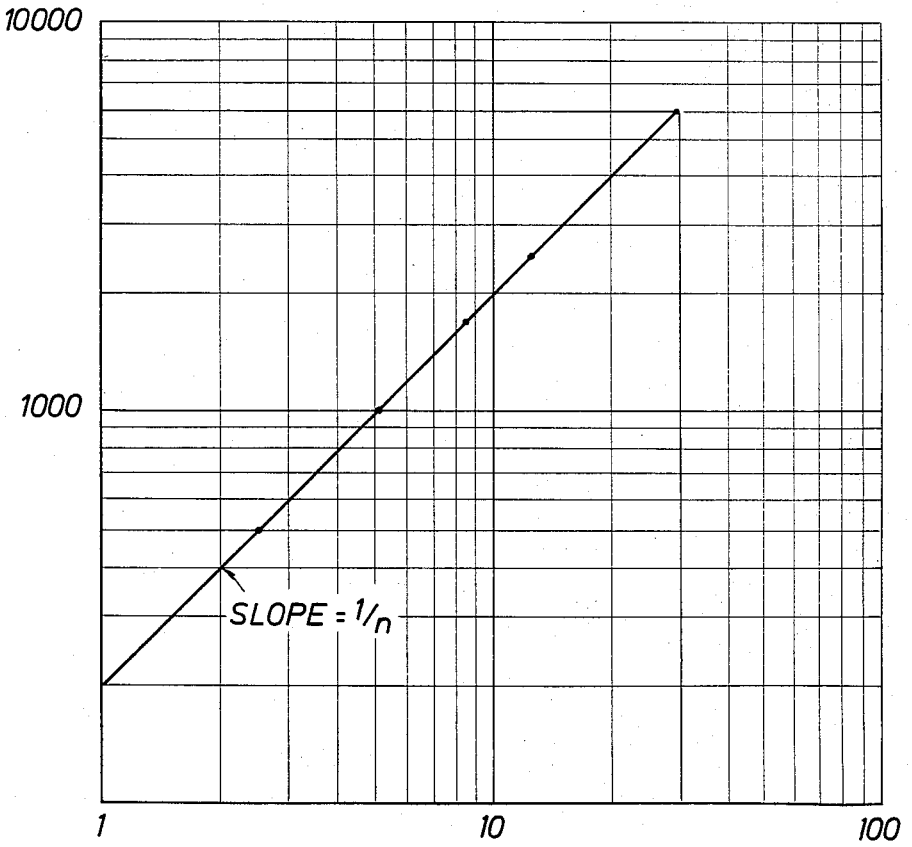
FIG. 9

MULTIPLE FLOW RATE FORMATION TESTING DEVICE AND METHOD

FIELD OF THE INVENTION

The present invention relates to methods and apparatus for measuring parameters in well bores which traverse earth formations, and more particularly to methods and apparatus for obtaining permeability and producibility measurements of formation intervals therein.

BACKGROUND OF THE INVENTION

During the drilling of a well, such as an oil well, progress is monitored by means of periodic measurements and tests. Some are made at the surface; others utilize sophisticated tools which are lowered into the well to make more proximate measurements of well bore parameters. Inferences and deductive evaluations about the well are then made based upon the results of such measurements, made at various depths within the well bore. Obviously, the greater the accuracy of the measurements, the more valid will be the deductions or calculations made from the measurements.

A well-known and important tool for measuring formation pressures and flow rates, and for obtaining one or more fluid samples from the earth formations, is a Formation Tester. When adapted to obtain a number of measurements or fluid samples, it is sometime called a multiple sample formation tester. One such tester, capable of making multiple measurements and taking multiple samples, is disclosed in U.S. Pat. No. 4,375,164 (Dodge et al., issued Mar. 1, 1983), assigned to the assignee of the present invention. As illustrated therein, the tool is adapted to be lowered into a well bore on an armored electrical cable, commonly known as a wire line. At the location in the well bore where a test is desired, a back-up shoe and an elastomeric sealing pad are projected laterally in opposite directions into engagement with opposite sides of the wall of the well bore. The sealing pad seals off a portion of the formation from the well bore, and a channel within the pad, oftentimes including a probe which extends therefrom into the formation, provides direct fluid communication between the tool and the formation interval thereadjacent. The flow channel then effectively opens the formation interval into the tool, where a pressure sensor provides a formation pressure measurement. If desired, a sampling chamber within the tool may also be connected to the formation, as by suitable valves, for obtaining and retaining therein a fluid sample which may then be retrieved at the surface when the tool is withdrawn from the well bore.

Another feature of such tools is the ability to perform pretests before a full fluid sample is drawn. The latter usually amounts to from 0.5 to 10 gallons, and usually can be drawn only once or twice (depending upon the tool configuration) for each trip of the tool into the well. A pretest, however, typically involves drawing only a small fluid sample, usually about 5 to 20 cc. Such samples can be drawn with a piston arrangement in which the fluid can then be purged and the piston used again to draw another sample. Initially, such tests help determine whether a good seal between the pad and the formation has been established. After the integrity of the seal is confirmed, more such pretests can be conducted to provide useful information about the permeability of the formation, as by monitoring the fluid flow rate as a function of the pressure differential generated as the piston draws in the sample.

Such prior art tools and methods, however, conducted as described above, have in fact been conducting pretest measurements, not of the permeability of the formation to its own connate fluids, but of the permeability of the formation to mud filtrate from the bore hole. These can be substantially different values. For example, suppose that the connate formation fluid is a gas. Clearly the gas, which is an inviscid fluid which is compressible, will have markedly different viscosity and flow characteristics from the drilling fluid, which is a somewhat viscous liquid which is incompressible. In such a case the permeability values obtained from a pretest which draws mud filtrate (well bore fluid) can be expected to be very distorted from the actual permeability of the undisturbed formation. This distortion effect can be further enhanced by formation damage in the immediate vicinity of the borehole (where the measurements in fact take place) caused by the well bore drilling fluids and well bore fluid pressures. (This latter change in apparent permeability is known as the "skin effect".)

A need therefore remains for an improved method and apparatus for determining more accurately the flow properties of a formation interval traversed by a bore hole. Preferably, such a method and apparatus will provide permeability information about the formation based upon actual connate formation fluids, and will minimize skin effect and other distortions caused by the well bore fluids.

SUMMARY OF THE INVENTION

Briefly, the present invention meets the above needs and purposes with a method and apparatus which, after establishing direct fluid flow communication within a well bore with a formation interval, then draws a sufficiently large fluid sample from the formation interval to substantially remove the well bore invasion fluid from the immediate area. Subsequent flow from the formation is therefore of connate fluid rather than well bore fluid. In the preferred embodiment, a plurality of flow tests is then made to determine the formation flow properties which obtain with the actual connate formation fluids. Preferably, the flow tests are essentially the same as the pretests discussed above, except that they occur after the well bore invasion fluids have been removed from the immediate area of the formation interval from which the fluid samples are being drawn. Also, the flow tests according to the present invention are essentially unlimited in number, and subject to control of either the flow rate or the differential flow pressure, to obtain additional information from which the formation properties may be more accurately determined.

It is therefore an object of the present invention to provide an improved method and apparatus for measuring the permeability of earth formations traversing a well bore; to provide such a method and apparatus which can also determine the deliverability of such a well bore against essentially any sandface back pressure, including a determination of the open flow potential of the well; in which direct fluid flow communication is established with the formation through the wall of the well bore, following which a sufficiently large fluid sample is drawn from the formation interval to substantially remove the well bore invasion fluid from the immediate area and to flow connate formation fluid instead, and then subsequently at least one flow test is made from the formation interval to determine the formation flow properties which obtain with the actual connate formation fluids; and to accomplish the above objects and purposes with a highly versatile, uncomplicated, economical and efficient method and apparatus readily suited for use in the widest possible range of bore hole drilling and measurement operations.

Other objects and advantages of the invention will be apparent from the following description, the accompanying drawings and appended claims.

BRIEF DESCRIPTION OF THE DRAWINGS

FIG. 1 is a figurative schematic illustration showing a well tool embodying the present invention located within a well bore;

FIG. 2 is a schematic representation of portions of the fluid sampling system within the well tool according to the present invention;

FIGS. 5 and 6 illustrate additional embodiments for making pretests at controlled rates;

FIG. 7 illustrates still another embodiment for making pretests at controlled rates;

FIG. 8 represents the pressure levels in the tool hydraulic control lines during operation of the embodiment illustrated in FIG. 7; and FIG. 9 is a graphical plot illustrating the determination, according to the present invention, of the deliverability of the well against any sandface back pressure.

DESCRIPTION OF THE PREFERRED EMBODIMENTS

Figure 3:
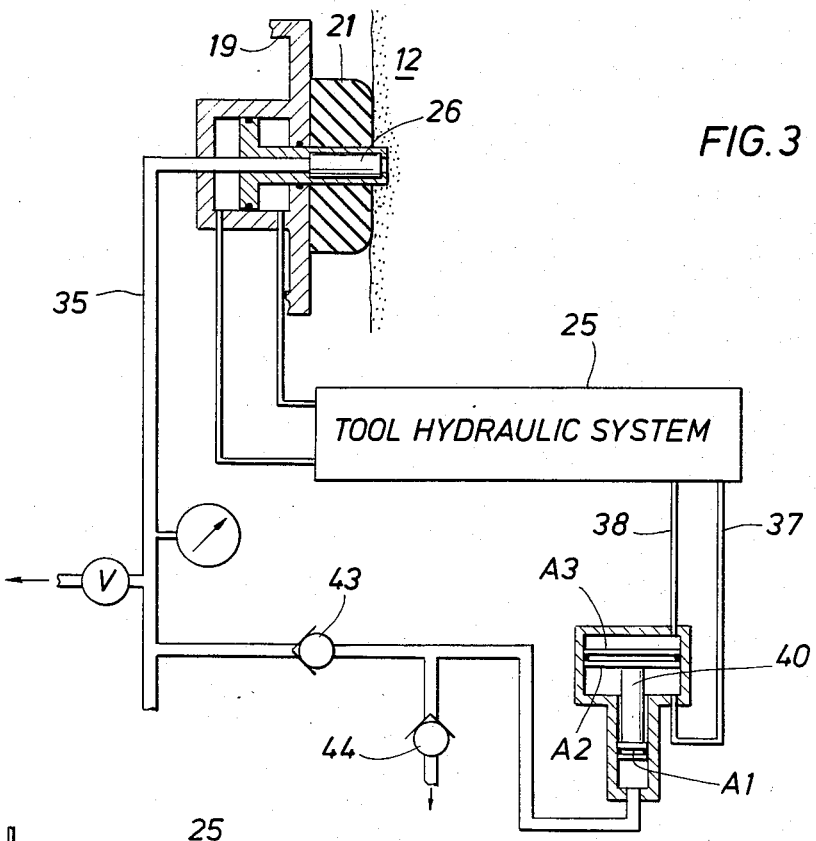
FIG. 3 illustrates fragmentarily an alternate embodiment of the system illustrated in FIG. 2, adapted for more easily purging fluids within the pretest chamber to the well bore.

With reference to the drawings, the new and improved formation testing tool for measuring the permeability of earth formations traversing a well bore, and the method therefor according to the present invention, will now be described. FIG. 1 shows, somewhat figuratively, a formation testing tool 10 as it would appear in the course of a typical formation fluid sampling and permeability measuring operation in a well bore 11. Well bore 11 traverses earth formations, including permeable formations 12 and 13, and is typically filled with a well control liquid such as drilling mud. Tool 10, shown adjacent, formation 12, is sized for passage through the well bore 11, and is connected to the end of an armored electrical cable 14, which is spooled at the earth's surface in conventional fashion on a suitable winch or reel (not shown). In addition to physically supporting and moving tool 10 within the bore hole 11, cable 14 also provides an electrical link with surface equipment such as a control system 15, recorder 16, and power supply 17, for transmission through the cable of electrical control signals, electrical power for the tool, and data between the tool and the equipment at the earth's surface.

The tool body 18 encloses the measuring system (described further below). Intermediate the length of the tool are a selectively extendible sealing pad 19 and an anchoring shoe 20. Pad 19 and shoe 20 are at diametrically opposite locations on the tool body and are adapted to be extended from a retracted position, with respect to the body, to an extended position in engagement with the wall of the well bore 11 on opposite sides thereof. In the extended positions of the pad and shoe, pad 19 presses its elastomeric sealing element 21 into fluid tight engagement with the wall of the well bore 11 so that a fluid sample from the earth formation thereadjacent may be routed through element 21 to the interior of tool 10 for measurement and/or retrieval. Element 21, when properly positioned against the well bore wall, establishes a seal with the formation which isolates the adjacent formation interval from the fluids within the well and establishes, through the wall of the well bore, direct fluid communication with the adjacent formation.

Referring to FIG. 2, a simplified schematic representation of portions of the fluid sampling system according to the present invention is illustrated. A tool hydraulic system 25 is connected for extending and retracting pad 19, a fluid sampling probe 26 therein, and backing shoe 20 (FIG. 1). A reservoir 27 is shown for supplying fluid, as needed, to system 25 through an intake line 28, and receiving discharged hydraulic fluid, as through a line 29. For a more complete description of the operation of the tool's hydraulic system 25, reference may be had to the above-noted U.S. Pat. No. 4,375,164, the disclosure of which is incorporated herein by reference.

As indicated above, after the pad is set, prior art wireline formation testers typically perform either one or two pretests, with fixed and constant flow rates. The tests are to determine if there is a good seal between the pad 19 and the formation (i.e., if the formation is isolated from the well bore fluids), to determine the formation pressure, and then to estimate formation permeability from the pressure measured by the pretest sample piston as the small pretest volume (5–20 cc) is drawn. If the formation flows readily, a large sample volume (0.5–10 gal.) of formation fluid may then be drawn into one of the sample chambers 32 or 33 by opening a corresponding sample chamber valve **32*a* or 33*a* in fluid sample flow line 35. After the sample is taken, the valve 32*a* or 33*a* is closed, pad 19 is retracted from the well bore wall, and the tool 10** is then ready to move to another location.

As shown in FIG. 2, a pretest is performed by supplying hydraulic fluid from hydraulic system 25 through first and second pretest lines 37 and 38 to a pretest piston 40. Piston 40 has effectively three surface areas: A1 which communicates with the fluid sample flow line 35, A2 which acts hydraulically in the same direction as A1 but is much larger in area (for hydraulically multiplying the pressures to be applied on surface A1), and A3 which opposes A1 and is also much larger in area. (As illustrated, surfaces A1 and A2 are on the undersides of piston 40.) Pretest line 37 first supplies hydraulic fluid to piston side or area A2, causing the piston to move up. This produces a reduction in pressure in the formation fluid flow line 35, at piston area A1. When the pressure at A1 is less than the formation pressure, the formation fluid can then flow into the piston due to the pressure differential. The difference between the static formation pressure P and the pressure p in the fluid sample flow line 35 during movement of piston 40 is the differential flow pressure.

At the conclusion of the test valve 41 may be closed and valve 42 may be opened. This will disconnect piston 40 from the fluid sample flow line 35 and connect its sampling side A1 through valve 42 to the well bore for discharging the fluid sample by supplying hydraulic fluid through line 38 to piston surface A3. This is preferable to forcing the fluid back into the formation. Rather than using valves which must be affirmatively actuated, passive check valves 43 and 44 may be used, as illustrated in FIG. 3.

As will be apparent, the pretest actuating hydraulic fluid in the FIG. 2 embodiment flows at a fixed rate through line 37. According to one feature of the present invention, the flow rate may be controlled continuously to make one or more flow tests with piston 40 at a constant differential flow pressure. Further, when more than one test is made, each may be at a different constant differential flow pressure (or at different constant flow rates, if desired). This may be accomplished by changing the motor speed in hydraulic system 25, or by changing the pump output therein by using a variable displacement pump.

Figure 4:
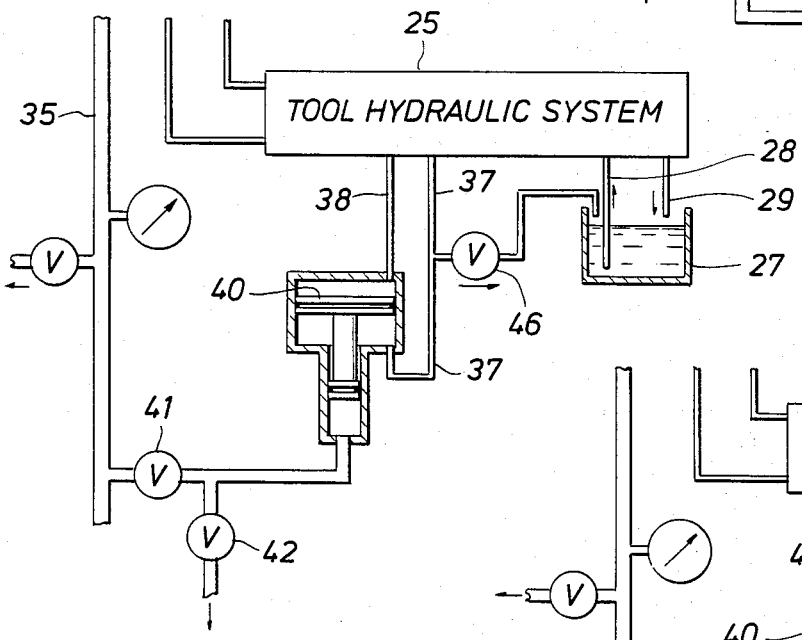
FIG. 4 shows schematically another embodiment of the FIG. 2 system provided with means for controlling the rate at which the pretest is taken.
Figure 5:
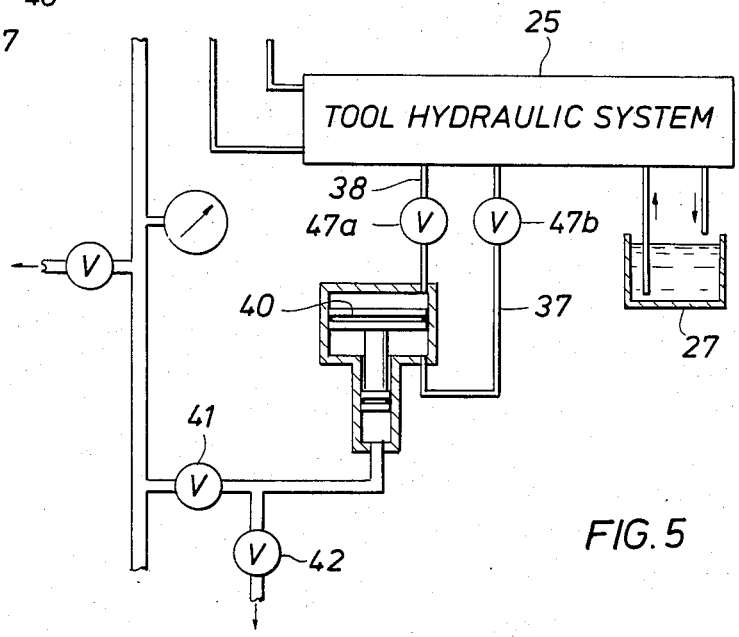

FIGS. 4–8 illustrate other means for controlling the flow rate of the hydraulic fluid supplied to side A2 of piston 40. In FIG. 4 an adjustable bypass valve 46 bleeds a controllable volume of the pump output back to the hydraulic reservoir 27. In FIG. 5, variable restrictions, such as throttle or needle valves 47*a* and 47*b*, may be placed in the actuating hydraulic line 37 or the exhaust hydraulic line 38. FIGS. 6 and 7 show a series of pistons 40*a*–40*d*, or pretest chambers. In FIG. 6 each piston has its own actuating solenoid valve 51*a*–51*d* and its own flow rate control valve or orifice 52*a*–52*d* which fixes the respective flow rate of the actuating hydraulic fluid to each pretest chamber, each orifice preferably having a different setting.

Finally, FIG. 7 shows sequence valves 53*a*–53*d* which open sequentially as the pressure rises in hydraulic line 37. This is, as fluid is first supplied to valves 53*a*–53*d*, the pressure rises until level 1 (see FIG. 8) is reached, at which pressure sequence valve 53*a* opens and lets hydraulic fluid flow to flow test chamber 40*a*. The output of hydraulic system 25 is preferably fixed by properly selecting the characteristic pump performance therein, so that the rate of movement of the flow test chambers is determined. Then, at the end of the stroke of chamber 40*a*, the pressure in line 37 rises until level 2 (FIG. 8) is reached. This causes valve 53*b* to open and lets hydraulic fluid flow to test chamber 40*b*, and so forth for valves 53*c* and 53*d* and chambers 40*c* and 40*d*. Further, by having different ratios of the areas A1 and A2 on each flow test chamber, multiple rate formation fluid flow tests can be provided with different fixed flow rates.

As taught by the present invention, is is particularly advantageous, and much information can be gained, by performing one or more of these tests after a large sample has been drawn into one of the sample chambers 32 or 33. Such tests will yield a much better estimate of formation permeability than a pretest performed before a large sample is taken, since the large sample removes substantially all of the well bore invasion fluid from the immediate area of the formation being tested, and flows connate formation fluid instead. This reduces the skin effect, which is the change in the flow characteristics around the well bore due to the invasion of drilling fluids into the formation. True connate formation fluids nearly always have a different viscosity than the well bore invasion fluid and thus flow differently. This is especially true, of course, of gas wells.

A standard practice during drill stem or production testing of gas wells is the four point flow test, in which the flow rate is changed three or four times and the flow rate and pressure histories are recorded. A graph of $\Delta p^2=(P^2-p^2)$ vs. q on logarithmic coordinates is constructed (see FIG. 9), where P = the average reservoir pressure obtained by shut-in of the well to complete stabilization, p = the flowing sandface pressure during a given test, q = the measured flow rate, C = a coefficient which describes the position of the stabilized deliverability line, and n = the inverse slope of the back pressure line or deliverability relationship defined by the plot of points.

C and n are constants characteristic of the well.

From this data the equation $q=C(P^2-p^2)^n$ can be solved for C and n, allowing one to determine the open flow potential of the well or the deliverability of the well against any sandface back pressure. More particularly, when the well is either drill stem tested or production tested, then any one test, at a given flow rate, will be sufficient to determine a point on the graph of $(P^2-p^2)$ vs. q, and thus allow one to solve for C. Then by utilizing several pretest results (taken after the large sample was drawn to purge the bore hole fluids from the formation) at different flow rates, the slope 1/n can be readily found.

As may be seen, therefore, the present invention has numerous advantages. First, it provides for comparing the change in formation permeabilities measured before and after the large sample is drawn to determine therefrom the extent of possible formation damage due to the prior invasion of drilling fluids from the well bore into the formation. It lends itself to an automatic control system which monitors the pressure in the formation fluid line 35 and automatically throttles to any desired differential pressure, allowing analysis of a formation using a spectrum of flow rates for many different differential pressure values. It provides a much more accurate determination of the formation flow properties by measuring with the actual connate formation fluids. It is easy and straightforward to implement, highly versatile, uncomplicated, economical and efficient, and readily suited for use in the widest possible range of bore hole drilling and measurement operations.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A method for measuring the permeability of earth formations traversing a well bore, comprising:

(a) establishing, through the wall of the well bore and isolated from fluids within the well bore, direct fluid flow communication with an adjacent formation interval, (b) drawing a first fluid sample from the formation interval to determine a first fluid permeability property for the interval, (c) drawing a second sufficiently large fluid sample from the formation interval to substantially remove the well bore invasion fluid from the immediate area and flow connate formation fluid instead, and (d) subsequently making at least one flow test from the formation interval to determine the formation flow permeability property which obtains with the actual connate formation fluids from the interval and comparing this permeability property with said first fluid permeability property to determine the extent of possible formation damage due to prior invasion of drilling fluids from the well bore into the formation.

2. The method of claim 1 further comprising making a plurality of flow tests after drawing the large fluid sample.

3. The method of claim 1 wherein said step of making at least one flow test further comprises making said test at a controlled flow rate.

4. The method of claim 3 wherein said step of making at least one flow test at a controlled flow rate further comprises making each such flow test at a constant differential flow pressure.

5. The method of claim 4 further comprising making a plurality of such flow tests each at a different constant differential flow pressure.

6. The method of claim 3 wherein said step of making at least one flow test further comprises making each such flow test at a constant fluid flow rate.

7. The method of claim 6 further comprising making a plurality of such flow tests each at a different constant fluid flow rate.

8. A method for determining the deliverability of a well against any sandface back pressure, including a determination of the open flow potential of the well, comprising:

(a) performing at least two permeability measurements according to the method of claim 1, (b) performing at least one high volume flow rate test of the well, and (c) using the data developed from the permeability tests to solve for n, and the date from the high volume test to solve for C, in the flow rate equation $q=C(P^2-p^2)^n$, where q equals the measured flow rate, P equals the average reservoir pressure obtained by shut-in of the well to complete stabilization, p equals the flowing sandface pressure during a given test, and C and n are constants characteristic of the well, whereby q may then be specified for the well for any sandface back pressure.

9. The method of claim 8 wherein said high volume flow test is performed before said permeability measurement.

10. The method of claim 8 wherein said high volume flow test is accomplished by performing at least one of a drill stem test or a production test.

11. A method for determining the deliverability of a well against any sandface back pressure, including a determination of the open flow potential of the well, comprising:

(a) performing at least one high volume flow rate test of the well by means of at least one of a drill stem test or a production test, (b) establishing, through the wall of the well bore and isolated from fluids within the well bore, direct fluid flow communication with a producing formation interval, (c) drawing a sufficiently large fluid sample from the formation interval to substantially remove the well bore invasion fluid from the immediate area and flow connate formation fluid instead, (d) subsequently making a plurality of flow tests from the formation interval, each test at a different constant controlled differential flow pressure, to determine the formation flow properties which obtain with the actual connate formation fluids, and (e) using the data developed from the permeability tests to solve for n, and the data from the high volume test to solve for C, in the flow rate equation $q=C(P^2-p^2)^n$, where q equals the measured flow rate of the well, P equals the average reservoir pressure obtained by shut-in of the well to complete stabilization, p equals the flowing sandface pressure during a given test, and C and n are constants characteristic of the well, whereby q may then be specified for the well for any sandface back pressure.

12. A formation testing tool for measuring the permeability of earth formations traversing a well bore, comprising:

(a) sample drawing means locatable within the well bore for establishing, through the wall of the well bore and isolated from fluids within the well bore, a direct fluid flow path communicating with an adjacent formation interval, (b) first fluid drawing means coupled with said sample drawing means for drawing therethrough a sufficiently large fluid sample from the adjacent formation interval to substantially remove the well bore invasion fluid from the immediate area and flow connate formation fluid instead, and (c) second fluid drawing means coupled with said sample drawing means for making at least one flow test from the adjacent formation interval prior to drawing the large fluid sample, and for making a plurality of formation flow tests from the adjacent formation interval subsequent to the drawing of the large fluid sample, each of the subsequent flow tests being drawn at a different controlled constant differential flow pressure, to determine more accurately the formation flow properties which obtain with the actual connate formation fluids.

* * * * *